US008573923B2

(12) United States Patent
Tibbott

(10) Patent No.: US 8,573,923 B2
(45) Date of Patent: Nov. 5, 2013

(54) COOLED AEROFOIL FOR A GAS TURBINE ENGINE

(75) Inventor: Ian Tibbott, Lichfield (GB)

(73) Assignee: Rolls-Royce PLC, London (GB)

( * ) Notice: Subject to any disclaimer, the term of this patent is extended or adjusted under 35 U.S.C. 154(b) by 676 days.

(21) Appl. No.: 12/706,386

(22) Filed: Feb. 16, 2010

(65) Prior Publication Data

US 2010/0254801 A1 Oct. 7, 2010

(30) Foreign Application Priority Data

Apr. 3, 2009 (GB) ..... 0905736.5

(51) Int. Cl.
*F01D 5/18* (2006.01)

(52) U.S. Cl.
USPC ..... 415/115; 416/97 R

(58) Field of Classification Search
USPC ..... 416/97 R
See application file for complete search history.

(56) References Cited

U.S. PATENT DOCUMENTS

| | | | | |
|---|---|---|---|---|
| 3,801,218 | A | 4/1974 | Moore | |
| 4,312,624 | A | 1/1982 | Steinbauer, Jr. et al. | |
| 5,356,265 | A | 10/1994 | Kercher | |
| 5,387,085 | A * | 2/1995 | Thomas et al. | 416/97 R |
| 5,577,884 | A * | 11/1996 | Mari | 415/115 |
| 5,669,759 | A | 9/1997 | Beabout | |
| 6,183,198 | B1 | 2/2001 | Manning et al. | |
| 7,481,623 | B1 * | 1/2009 | Liang | 416/97 R |
| 7,862,299 | B1 * | 1/2011 | Liang | 416/97 R |
| 2005/0058546 | A1 * | 3/2005 | Cooper | 416/97 R |
| 2006/0222493 | A1 * | 10/2006 | Liang | 416/97 R |
| 2007/0128028 | A1 | 6/2007 | Liang | |

(Continued)

FOREIGN PATENT DOCUMENTS

| | | |
|---|---|---|
| EP | 1 533 474 A2 | 5/2005 |
| EP | 1 584 790 A2 | 10/2005 |
| JP | A-4-358701 | 12/1992 |
| SU | 1 287 678 A2 | 2/1997 |

OTHER PUBLICATIONS

Jul. 29, 2009 Search Report issued in British Patent Application No. 0905736.5.

(Continued)

*Primary Examiner* — Nathaniel Wiehe
*Assistant Examiner* — Aaron Jagoda
(74) *Attorney, Agent, or Firm* — Oliff & Berridge, PLC

(57) ABSTRACT

A cooled aerofoil for a gas turbine engine has an aerofoil section with pressure and suction surfaces extending between inboard and outboard ends thereof. The aerofoil section includes first and second internal passages for carrying cooling air. The aerofoil section further includes a plurality of holes in the external surface of the aerofoil section which receive cooling air from the internal passages. The external holes are arranged such that cooling air exiting a first portion of the external holes participates in a cooling film extending from the leading edge of the aerofoil section over said pressure surface and cooling air exiting from a second portion of the external holes participates in a cooling film extending from the leading edge over said suction surface. The first portion of external holes receives cooling air from the first internal passage, and the second portion of external holes receives cooling air from the second internal passage. The first and second internal passages are supplied with cooling air from respective and separate passage entrances. Each entrance is located at either the inboard end or the outboard end of the aerofoil section.

13 Claims, 11 Drawing Sheets

(56) References Cited

U.S. PATENT DOCUMENTS

| | | | | |
|---|---|---|---|---|
| 2007/0253815 | A1* | 11/2007 | Kopmels et al. | 416/97 R |
| 2008/0056908 | A1* | 3/2008 | Morris et al. | 416/97 R |
| 2008/0240919 | A1 | 10/2008 | Liang | |

OTHER PUBLICATIONS

Nov. 28, 2012 European Search Report issued in EP Application No. 10153720.

* cited by examiner

COOLED AEROFOIL FOR A GAS TURBINE ENGINE

The present invention relates to a cooled aerofoil for a gas turbine engine.

The performance of the gas turbine engine cycle, whether measured in terms of efficiency or specific output, is improved by increasing the turbine gas temperature. It is therefore desirable to operate the turbine at the highest possible temperature. For a given engine compression ratio or bypass ratio, increasing the turbine entry gas temperature will produce more specific thrust (e.g. engine thrust per unit of air mass flow).

However, in modern engines, the high pressure (HP) turbine gas temperatures are now much hotter than the melting point of the aerofoil materials, necessitating internal air cooling of the aerofoils. In some engines the intermediate pressure (IP) and low pressure (LP) turbines are also cooled, although during its passage through the turbine the mean temperature of the gas stream decreases as power is extracted.

Internal convection and external films are the prime methods of cooling the aerofoils. HP turbine nozzle guide vanes (NGVs) consume the greatest amount of cooling air on high temperature engines. HP blades typically use about half of the NGV flow. The IP and LP stages downstream of the HP turbine use progressively less cooling air.

FIG. 1 shows an isometric view of a conventional single stage cooled turbine. Cooling air flows to and from an NGV 1 and a rotor blade 2 are indicated by arrows. The cooling air cools the NGV and rotor blade internally by convection and then exits the NGV and rotor blade through many small exterior holes 3 to form cooling films over the external aerofoil surfaces.

The cooling air is high pressure air from the HP compressor that has by-passed the combustor and is therefore relatively cool compared to the gas temperature in the turbine. Typical cooling air temperatures are between 800 and 1000 K. Gas temperatures can be in excess of 2100 K.

The cooling air from the compressor that is used to cool the hot turbine components is not used fully to extract work from the turbine. Extracting coolant flow therefore has an adverse effect on the engine operating efficiency. It is thus important to use this cooling air as effectively as possible.

A number of different cooling configurations are conventionally employed to cool NGV aerofoils. A fundamental problem is to produce a configuration that gives high levels of internal heat transfer and at the same time provides a source of cool air at the correct pressure level from which to feed the film cooling holes at the desired blowing rate. In addition the exhausting coolant can only be bled onto the aerofoil external surface at certain locations otherwise the turbine efficiency will be detrimentally affected. The locations where it is acceptable to bleed coolant in the form of films onto the aerofoil surface are: the leading edge, the early suction surface (upstream of the throat), the pressure surface and the trailing edge. Coolant cannot be bled onto the mid-body and late suction surfaces due to the significant mixing losses that would be caused.

The static pressure distribution around the aerofoil surface dictates the local internal pressure level required to provide films to protect the aerofoil from the hot gas. The external pressure is at a maximum at the leading edge and does not fall much along the pressure surface until approximately 70% along the surface towards the trailing edge. In contrast the local static pressure falls very quickly around the suction surface and remains low all the way to the trailing edge.

These pressure constraints dictate the nature of the flow passages that can be employed within the aerofoil. For instance, the internal coolant flow must be kept at a high pressure in the vicinity of the aerofoil leading edge and on the pressure surface, and therefore the velocity of the flow must also be kept low to reduce frictional pressure losses.

On the other hand the film cooling flow that is bled on to the suction surface does not need to be supplied from a high pressure source, due to the low mainstream static sink pressure—a direct consequence of the high Mach number of the flow. The film cooling effectiveness is usually very high on the early suction surface of the aerofoil, however in the interests of aerodynamic efficiency, it is generally only acceptable to bleed film cooling flow onto the aerofoil suction surface where the mainstream gas is accelerating—upstream of the aerofoil throat.

FIG. 2 shows a cross-sectional view through a conventional HP turbine NGV aerofoil. The position of the leading edge and trailing edge are respectively indicated with an "L" and a "T". The approximate direction of hot gas flow towards and around the aerofoil is indicated by arrows. The aerofoil employs a cooling arrangement commonly used in high temperature turbines. The aerofoil cooling cavity has two passages, a forward passage 4, and a rearward passage 5. The forward passage is generally kept at a higher pressure than the rearward passage. A dividing wall 6 between the passages provides the aerofoil with structural support to prevent ballooning of the external walls caused by the differential pressure gradients across these walls. A thermal barrier coating (TBC—not shown) covers the outer surface of the aerofoil.

The forward passage 4 supplies coolant to the exterior holes 3 which form films at the leading edge, the early pressure side and the early suction side. The velocity of the coolant directed into the forward passage is kept low to maintain the static pressure at a high level in order to feed the leading edge cooling holes and to prevent hot gas ingestion. However, the low velocity of the flow reduces its Reynolds number, and therefore the amount of internal heat transfer. This has implications for the aerofoil metal temperature on the suction surface, which relies totally on the upstream films and TBC to protect it against the hot gas. During operation in the field, cooling hole blockage can occur and this generally leads to the bond coat for the TBC oxidising followed by TBC spallation. The suction surface is now exposed to the hot gas, and thermal cracking and oxidation can rapidly undermine the integrity of the aerofoil. Typically, the external wall of the aerofoil balloons under the pressure gradient and rupture of the wall occurs followed by hot gas ingestion as the internal pressure falls.

Turning to the rearward passage 5, because mid-chord pressure surface exterior holes are bled from this passage the pressure once again has to be kept relatively high. In order to produce a high level of heat transfer on the suction surface an impingement plate 7 is inserted into the passage, holes (not shown) in the plate producing jets of cooling air which impinge on the suction surface exterior wall at a relatively high velocity. However the plate can become displaced which undermines the impingement jet performance. The manufacture and installation of this plate also adds to costs.

The present invention seeks to address problems with known aerofoil cooling arrangements.

In general terms, the present invention provides a cooled aerofoil for a gas turbine engine in which the flows of cooling air to exterior holes serving aerofoil surfaces which experience different external static pressures can be kept separate to a greater degree than in known cooling arrangements. This allows the flow conditions in the respective flows to be better suited to the requirements of the two surfaces.

More particularly, an aspect of the present invention provides a cooled aerofoil for a gas turbine engine, the aerofoil having an aerofoil section with pressure and suction surfaces extending between inboard and outboard ends thereof, wherein the aerofoil section includes:

first and second internal passages for carrying cooling air, and a plurality of holes in the external surface of the aerofoil section which receive cooling air from the internal passages, the external holes being arranged such that cooling air exiting a first portion of the external holes participates in a cooling film extending from the leading edge of the aerofoil section over said pressure surface and cooling air exiting from a second portion of the external holes participates in a cooling film extending from the leading edge over said suction surface; and wherein the first portion of external holes receives cooling air from the first internal passage, the second portion of external holes receives cooling air from the second internal passage, and the first and second internal passage are supplied with cooling air from respective and separate passage entrances, each entrance being located at either the inboard end or the outboard end of the aerofoil section. Preferably, the aerofoil is a stator vane, such as a nozzle guide vane.

The separate passages entrances allow different pressure and flow regimes to be produced in the first and second internal passages, and these flow regimes can be adapted to match the varying hot gas external static pressure around the aerofoil. They can also be adapted to provide more internal convection cooling at locations (such as the late suction surface) where external film cooling is less effective or local film cooling bleed impractical.

Typically, the first and second internal passages are separated by a dividing wall which extends from the leading edge of the aerofoil, Thus the first passage can serve principally the pressure side of the aerofoil (with its higher external hot gas static pressure) and the second passage can serve principally the suction side of the aerofoil (with its lower external hot gas static pressure).

The first internal passage may be supplied with cooling air from passages entrances located at both the inboard end and outboard end of the aerofoil section. This can help to reduce the effect of entrance losses incurred when directing the cooling air into the first passage. Preferably, the first internal passage contains a baffle to prevent cooling air supplied by the entrance located at one of the inboard and outboard ends from exiting the first internal passage at the entrance located at the other of the inboard and outboard ends. In conventional aerofoils a similarly positioned baffle could lead to a zero flow velocity and low internal heat transfer at the suction surface. However, in the present invention, the suction surface can be cooled primarily by the cooling air flow in the second internal passage, and thus the baffle in the first passage does not have this attendant disadvantage.

Preferably, the second internal passage is a radial multi-pass passage which extends along a serpentine path from its entrance to the passage towards the leading edge of the aerofoil. Such a configuration for the second passage can provide high levels of internal heat transfer, and a significant pressure drop between the entrance to the second passage and the external holes served by the passage which matches the cooling air pressure at the holes to the external hot gas static pressure. For example, the second internal passage may make at least two changes of direction between its entrance and the leading edge of the blade.

The second internal passage may have a fore section which extends towards the leading edge and an aft section, the cooling air entering the aft section before the fore section, the flow direction of the cooling air in the aft section being predominantly radial, and the flow direction of the cooling air in the fore section being predominantly in aft-fore direction. The aft section can make, for example, a single radial pass or multiple radial passes along a serpentine path. Typically, the fore section has flow-disrupting formations on its internal surface to increase heat transfer between the cooling air and the aerofoil section and to increase pressure losses, thereby matching the cooling air pressure at the externals holes served by the passage to the external hot gas static pressure.

Indeed, the second internal passage may have such flow-disrupting formations more generally on its internal surface.

Preferably, the passage entrances widen in the direction opposite to the direction of air supply. This helps to reduce pressure losses at the entrances.

Preferably, the entrance for the second internal passage is located at the inboard end of the aerofoil section. As inboard sources of cooling air are generally cleaner than outboard sources of cooling air, this helps to avoid blocking of the external holes served by the second passage and blocking of flow paths between any flow-disrupting formations provided in the passage.

The aerofoil section may include a further external hole or holes at its trailing edge, the second internal passage also supplying cooling air to the trailing edge external hole(s).

Advantageously, the aerofoil may be manufactured using conventional casting and tooling procedures. For example, the aerofoil can be investment cast using the lost wax process, and the first and second internal passages can be formed in the casting by two respective cores that are assembled in the wax die. The cores can be held in their respective positions by core printouts at one of both ends of the aerofoil and/or bumpers on the surfaces of the cores at about their mid-span position. Thus preferably, the cooled aerofoil is a casting, the internal passages being formed during the casting procedure.

Embodiments of the invention will now be described by way of example with reference to the accompanying drawings in which:

FIG. 3(*b*) shows a sectional view along dashed line A-A of FIG. 3(*a*);

FIG. 3(*c*) shows a sectional view along dashed line B-B of FIG. 3(*a*);

FIG. 4(*b*) shows a sectional view along dashed line A-A of FIG. 4(*a*);

FIG. 4(*c*) shows a sectional view along dashed line B-B of FIG. 4(*a*);

FIG. 5(*b*) shows a sectional view along dashed line A-A of FIG. 5(*a*);

FIG. 5(*c*) shows a sectional view along dashed line B-B of FIG. 5(*a*);

FIG. 3(*a*) shows a cross-sectional view through a first embodiment of an HP turbine NGV aerofoil, FIG. 3(*b*) shows a sectional view along dashed line A-A of FIG. 3(*a*), and FIG. 3(*c*) shows a sectional view along dashed line B-B of FIG. 3(*a*).

Figure 1:
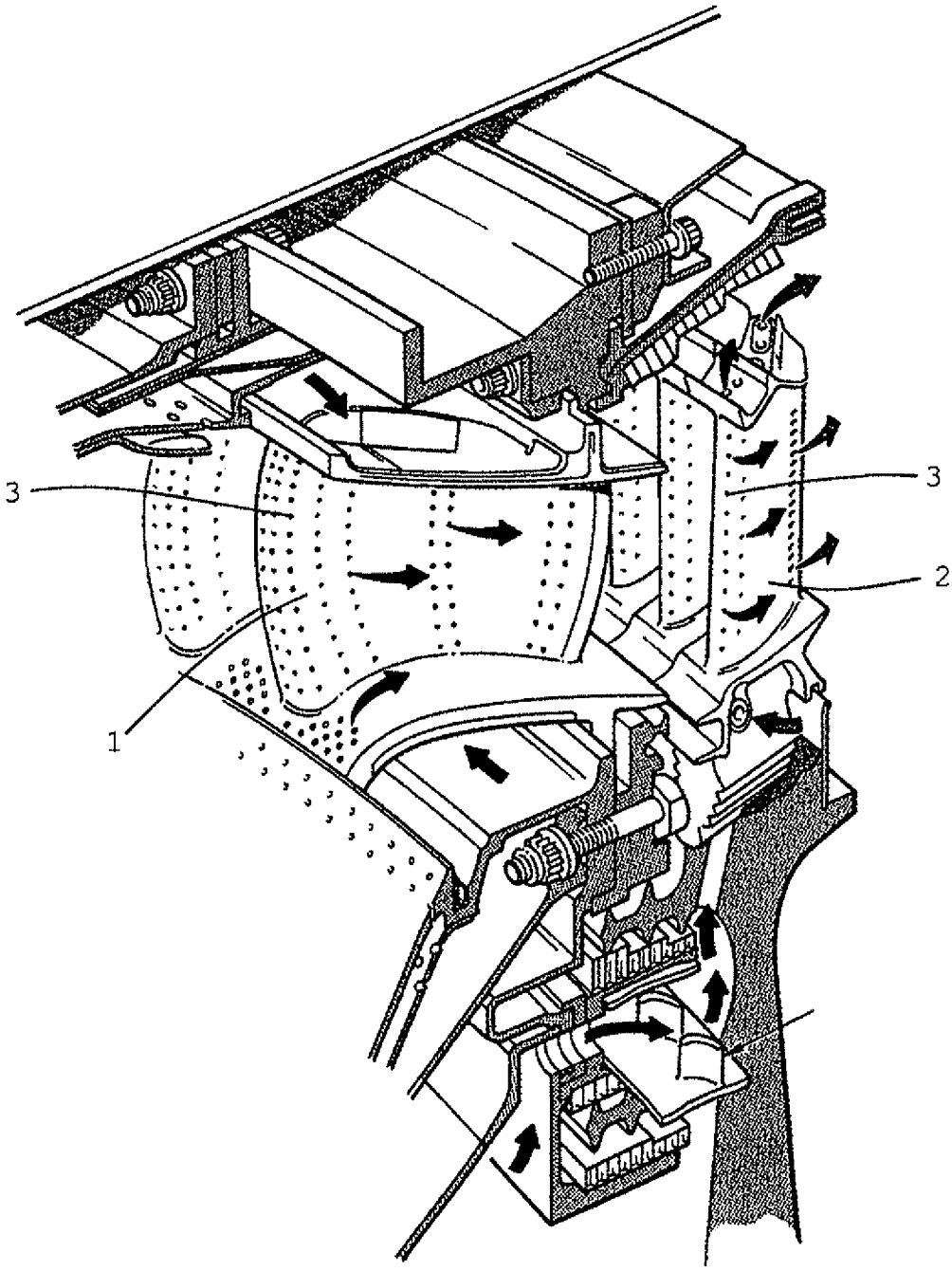
FIG. 1 shows an isometric view of a conventional single stage cooled turbine.
Figure 2:
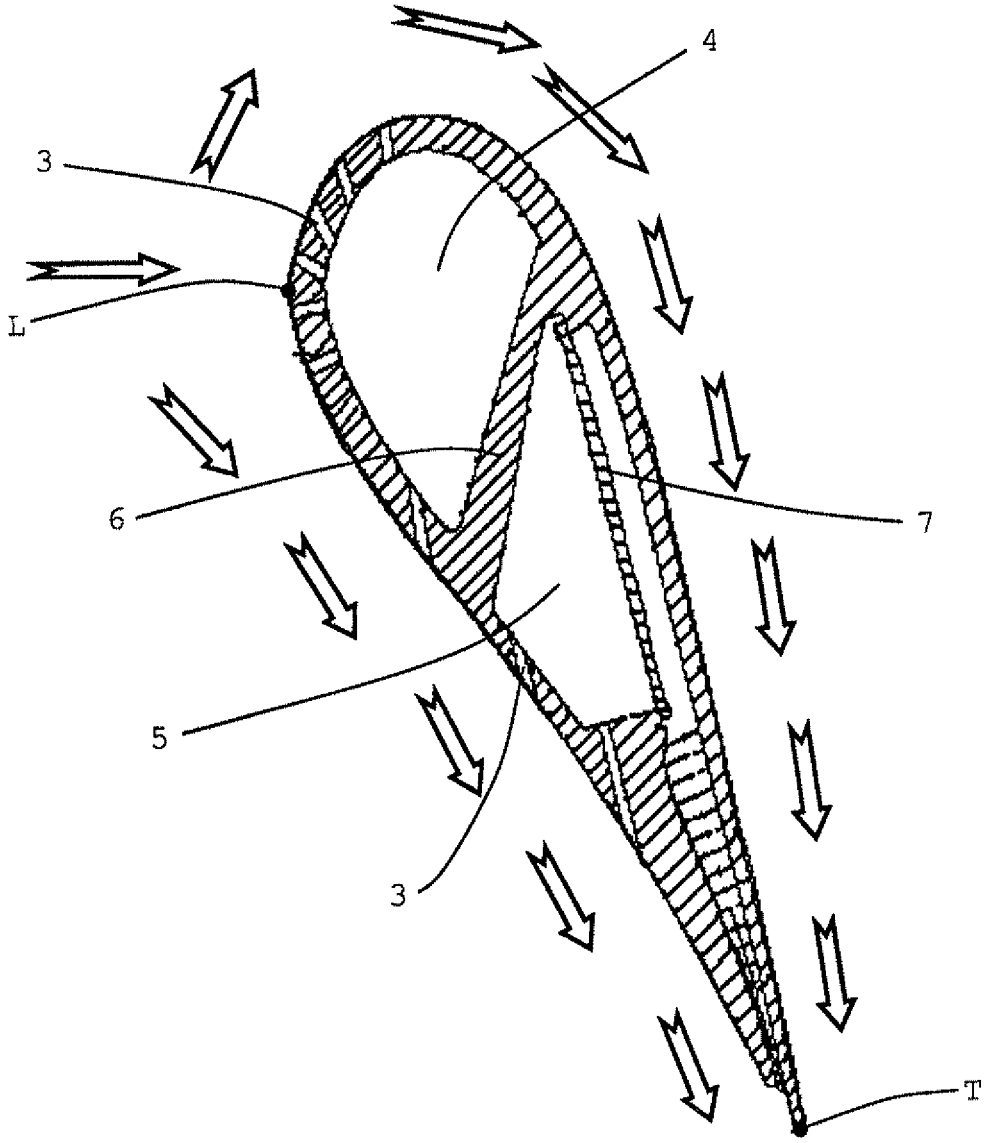
FIG. 2 shows a cross-sectional view through a conventional HP turbine NGV aerofoil.

The aerofoil has an aerofoil section defined by pressure and suction surfaces which meet at a leading edge L and at a trailing edge T. The aerofoil section has a first internal passage 14 which receives cooling air from inboard 16 and outboard 17 passage entrances at the ends of the aerofoil section, and a second internal passage 15 which receives cooling air from separate inboard passage entrance 18. Each of the passage entrances has a "bell-mouth" shape which widens in the direction opposite to the direction of air supply. This shape helps to reduce pressure losses on entry of the cooling air into the internal passages.

The first internal passage 14 extends radially between its entrances 16, 17 across the blade, and also extends forwards towards the leading edge L.

The second internal passage 15 is a triple-pass passage which follows a serpentine path containing two 180° turns. Each pass extends along the radial direction of the aerofoil, but the overall direction of flow is forwards from entrance 18 towards the leading edge of the aerofoil section, entrance 18 being rearward of entrances 16, 17.

A dividing wall 19 extending rearwards from the leading edge L separates the first 14 and the second 15 passages so that the cooling air of one passage can only come into communication with the cooling air of the other passage externally of the aerofoil.

Figure 3A:
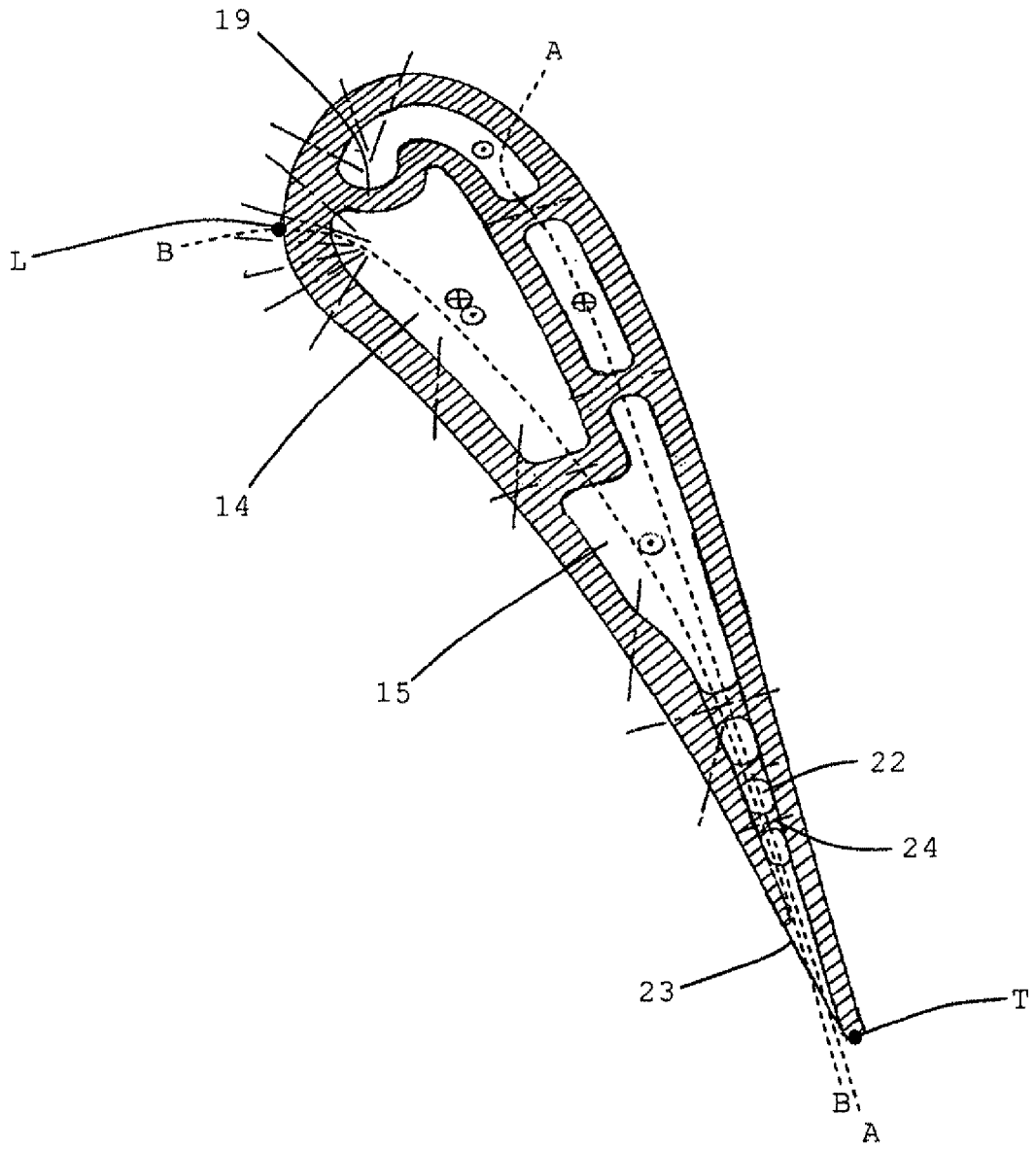
FIG. 3(*a*) shows a cross-sectional view through a first embodiment of an HP turbine NGV aerofoil.
Figure 3B:
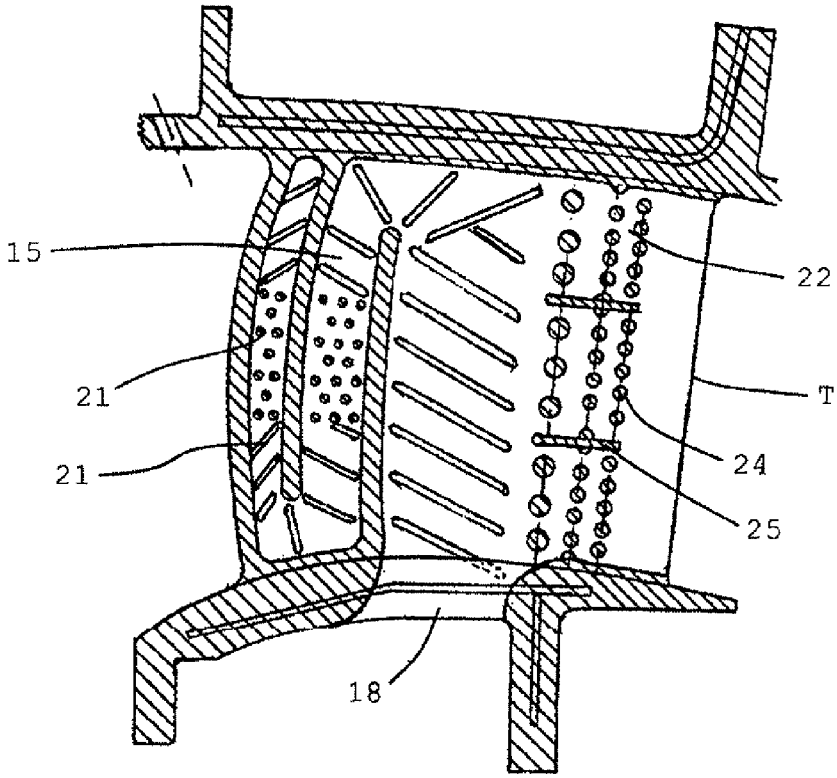
Figure 3C:
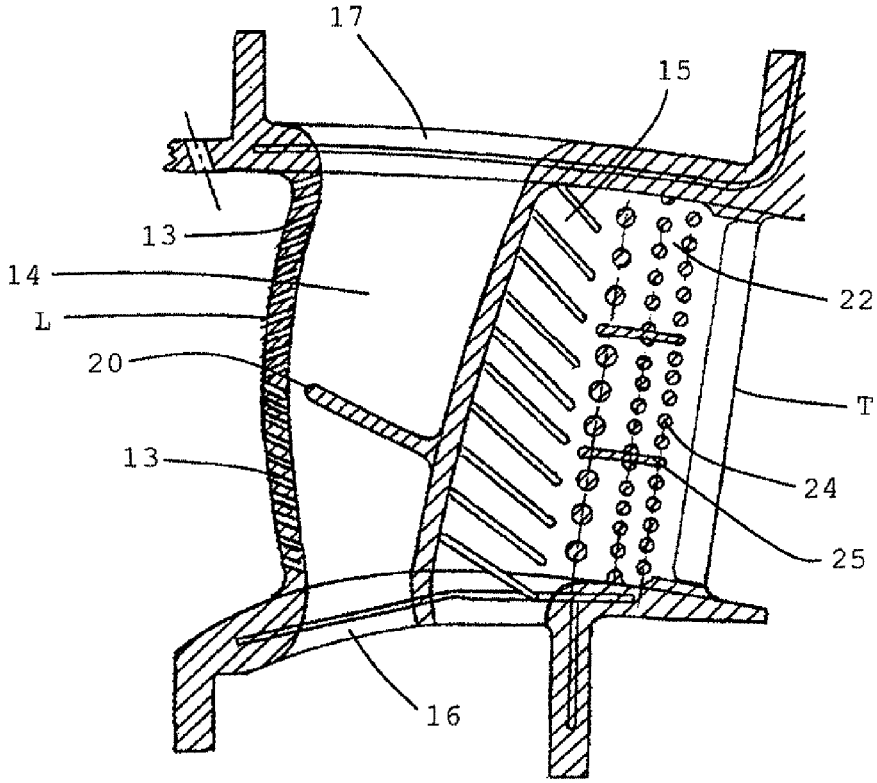

At the leading edge L, and to either side of the leading edge, are formed a plurality of external holes 13 (not shown in FIG. 3(*a*), although the centre lines of the holes are indicated by dot-dashed lines) which penetrate the outer wall of the aerofoil section and allow the cooling air delivered by passages 14, 15 to exit the aerofoil section and participate in cooling layers which form on the outer surface of the section.

The first passage 14 contains a mid-span baffle 20 which directs the airflow towards the leading edge L, and prevents cooling air supplied by inboard entrance 16 from exiting the passage at outboard entrance 17 and vice versa. Otherwise, the first passage is relatively free of flow-disrupting formations, which reduces frictional pressure losses in the cooling air flow in the passage. The result is that the pressure of the cooling air at the external holes 13 fed by the first passage is relatively high. However, these external holes are located at (i) the leading edge L, (ii) a short distance along the suction side from the leading edge, and (iii) along the pressure side from the leading edge, which are also locations where the static pressure of the surrounding hot gas is high, so that the exiting gas can form cooling layers on the aerofoil section external surface.

The final pass of the second passage 15 feeds other external holes 13, but these are located further round the suction side from the leading edge L. Here the static pressure of the surrounding hot gas is much lower, and consequently, in order that the exiting gas can participate in the suction side cooling layer, the pressure of the cooling gas in the final pass of the second passage must be reduced. This is achieved by the serpentine flow path of the second passage, and the incorporation of numerous flow-disrupting formations 21 in the passage, such as trip strips, pedestals and pin-fins, which cause frictional pressure losses. Advantageously, these features, as well as reducing the pressure of the cooling air in the passage also enhance the transfer of heat from the suction side external wall of the aerofoil section to the cooling air. Thus suction side cooling can be enhanced precisely in regions where the low static pressure of the surrounding hot gas makes it difficult to provide an external cooling layer.

As entrance 18 to the second passage 15 is an inboard entrance the cooling air which it receives is relatively clean, dirt and compressor debris particles tending to be in greater quantities in the outboard cooling air due to the centrifugal effects from the compressor. This reduces the risk that the fewer, but proportionately more critical, external holes 13 fed by passage 15 do not become blocked. Also the paths for the cooling air between the flow-disrupting formations 21 are less susceptible to becoming blocked.

The second passage 15 also carries cooling air with an axial rearward flow into a trailing edge cavity 22 which has an external exit on the late pressure surface through a continuous radial slot 23, providing film cooling protection to the aerofoil's extreme trailing edge T. Flow-disrupting formations 24 in the cavity, such as trip strips, pedestals and pin-fins cause frictional pressure losses. Bracing walls 25 support the external walls of the cavity and also direct the cooling air flow rearwards.

Figure 4A:
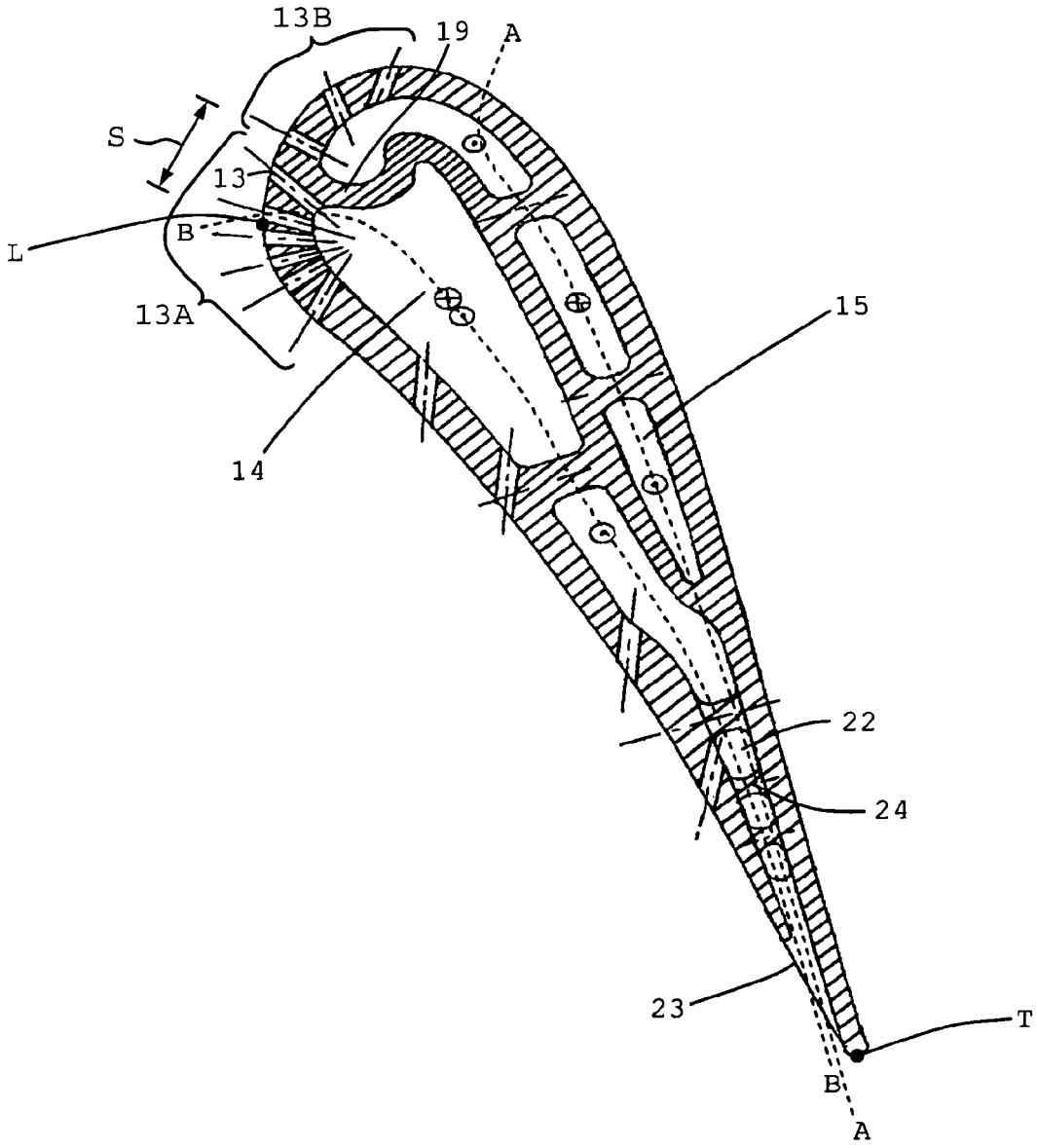
FIG. 4(*a*) shows a cross-sectional view through a second embodiment of an HP turbine NGV aerofoil.
Figure 4B:
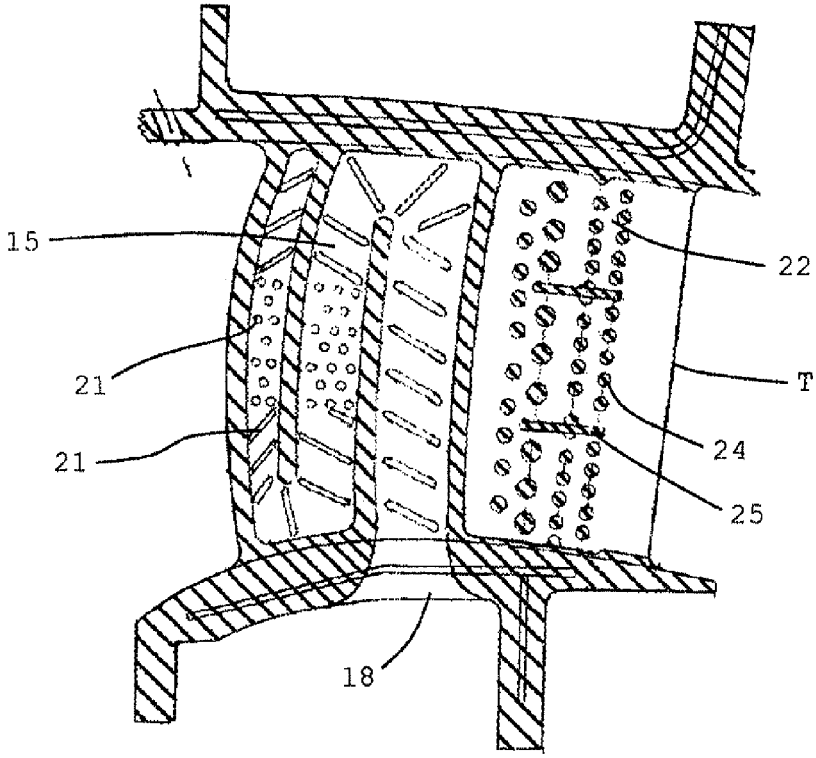
Figure 4C:
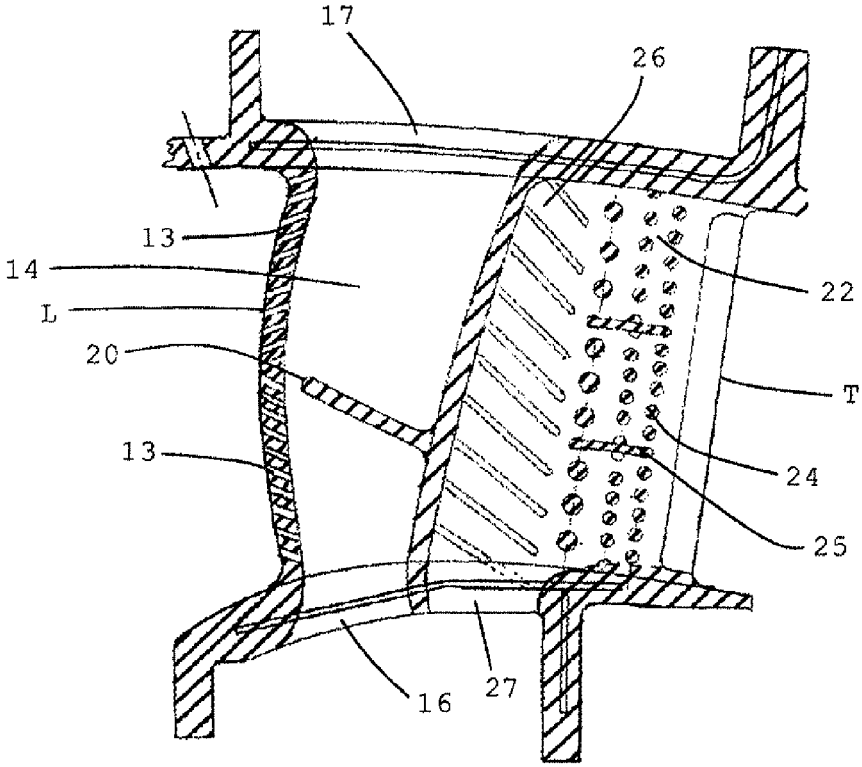

FIG. 4(*a*) shows a cross-sectional view through a second embodiment of an HP turbine NGV aerofoil, FIG. 4(*b*) shows a sectional view along dashed line A-A of FIG. 4(*a*), and FIG. 4(*c*) shows a sectional view along dashed line B-B of FIG. 4(*a*).

The second embodiment is similar to the first embodiment, and the same reference numbers/letters denote identical or similar features. However, in this case first passage 14 is larger than in the first embodiment, extending further downstream on the pressure surface to better accommodate high external static pressures that may extend beyond the mid-chord region of the aerofoil.

The second passage 15 is again a triple-pass passage. However, in this embodiment a third and separate radially-extending internal passage 26, fed by an inboard entrance 27, carries cooling air with an axial rearward flow into the trailing edge cavity 22.

In FIG. 4(*a*) passage 14 feeds effusion cooling holes 13A and passage 15 feeds effusion cooling holes 13B of the plurality of cooling holes 13. The exact position where the static pressure is too low for the cooling flow through passage 14 to form an effusion cooling flow over the suction surface will vary for each application, design of blade or vane and operational conditions. The position of where the static flow becomes too low is indicated by the distance S from the leading edge L. Thus the two groups of cooling holes 13A and 13B are adjacent one another in the direction from leading edge to trailing edge, around the suction surface 40, and the distance S is between the two groups of cooling holes 13A, 13B. It is important to ensure that the cooling air passing through the cooling holes 13 is at a pressure and jet velocity that ensures the maximum amount of coolant issues over the surface of the aerofoil rather than mixing with the hot main gases passing the aerofoil. Too great a pressure or velocity and the coolant mixes with the main gases, too little pressure and insufficient coolant issues.

Figure 5A:
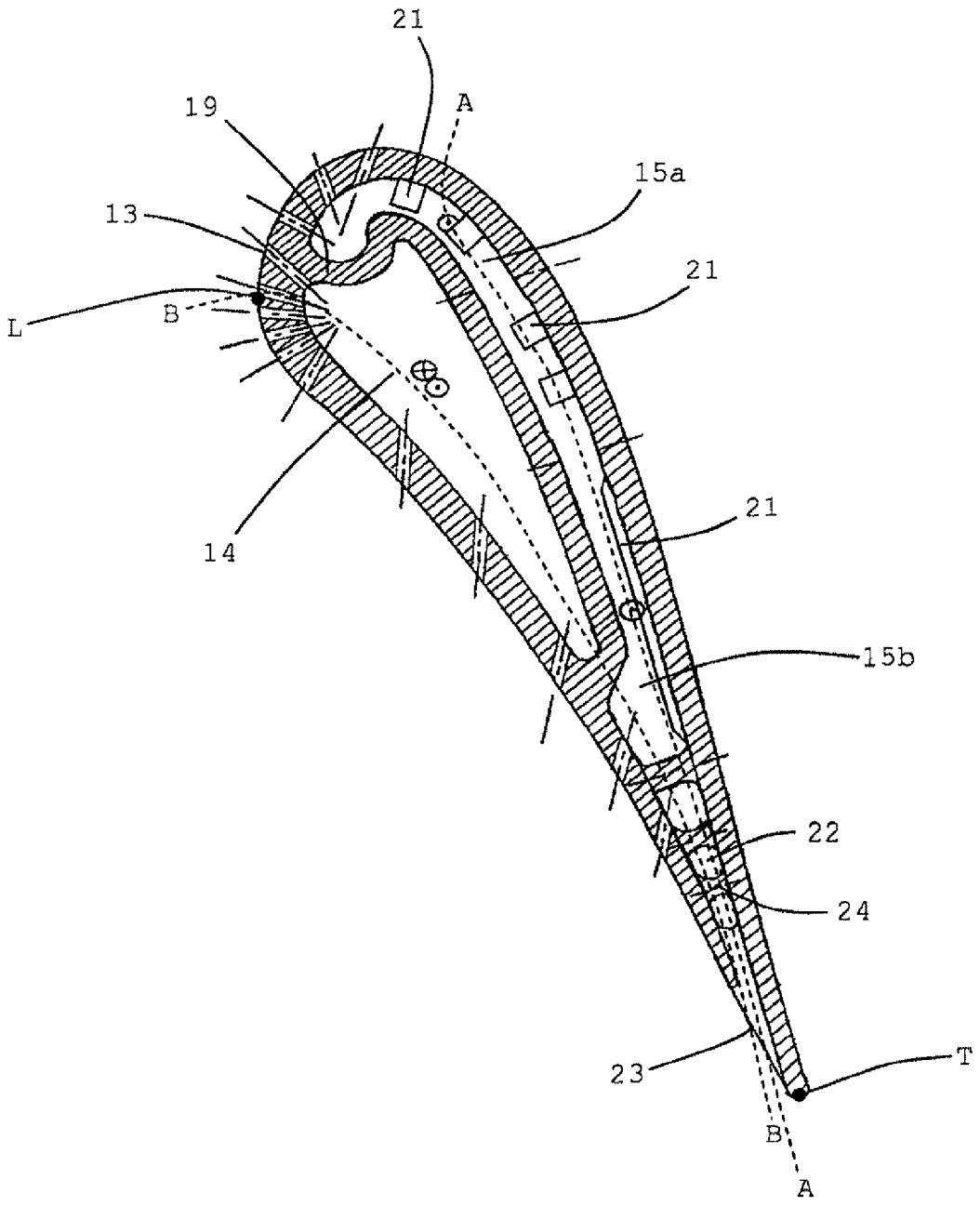
FIG. 5(*a*) shows a cross-sectional view through a third embodiment of an HP turbine NGV aerofoil.
Figure 5B:
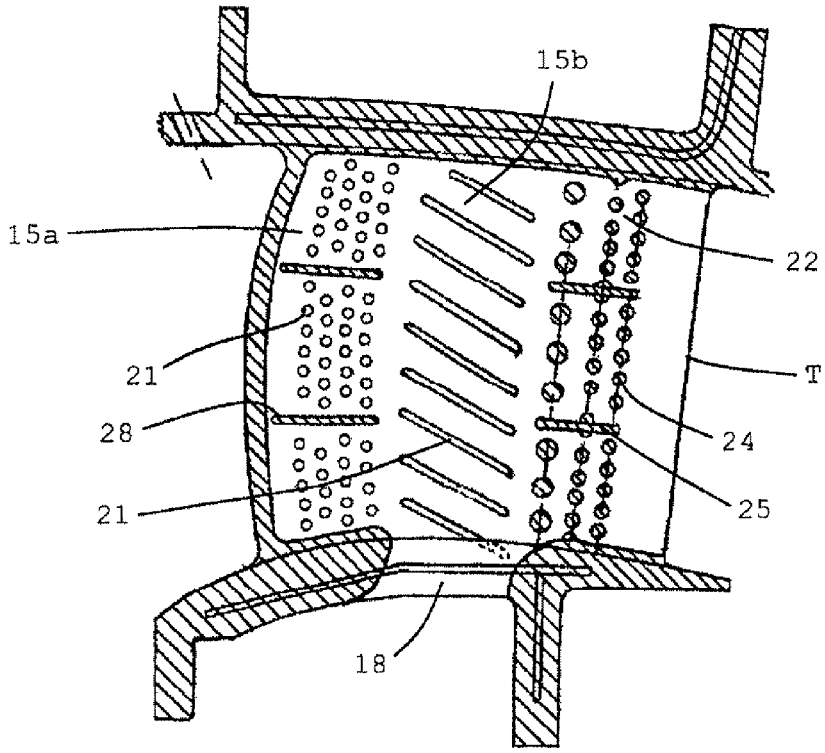
Figure 5C:
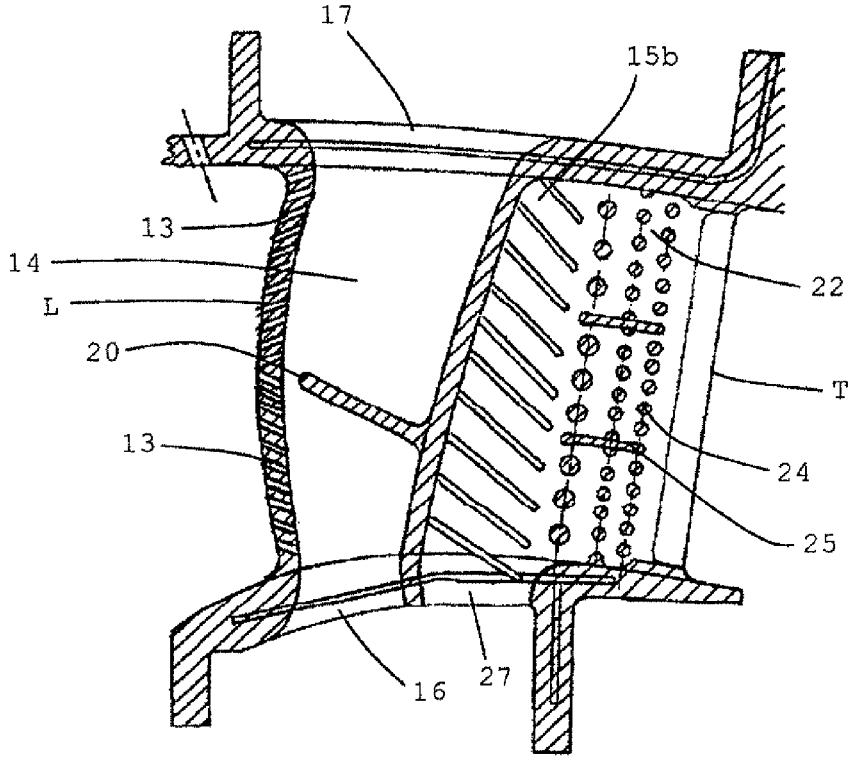

FIG. 5(*a*) shows a cross-sectional view through a third embodiment of an HP turbine NGV aerofoil, FIG. 5(*b*) shows a sectional view along dashed line A-A of FIG. 5(*a*), and FIG. 5(*c*) shows a sectional view along dashed line B-B of FIG. 5(*a*).

The third embodiment is again similar to the first embodiment. However, second passage is not serpentine but rather has a fore section 15*a* which extends towards the leading edge and an aft section 15*b*. Both the fore and aft sections extend the length of the aerofoil, with the forward edge of the aft section merging into the rearward edge of the fore section. Alternatively, the forward and aft sections of the second passage could be separated by a radial divider wall that bisects the inboard entrance. The cooling air enters the aft section though inboard entrance 18 before flowing into the fore section. The flow direction of the cooling air in the aft section is predominantly radial, and the flow direction of the cooling air in the fore section is predominantly in aft-fore direction.

Flow-disrupting formations 21 in both sections 15*a*, 15*b* of the second passage, such as trip strips, pedestals and pin-fins, cause frictional pressure losses. Further, bracing walls 28 in the fore section 15*a* support the external wall of the passage and also direct the cooling air flow forwards.

The aft section 15*b* also carries cooling air with an axial rearward flow into the trailing edge cavity 22 which has an external exit on the late pressure surface through the continuous radial slot 23, providing film cooling protection to the aerofoil's extreme trailing edge T.

Figure 6:
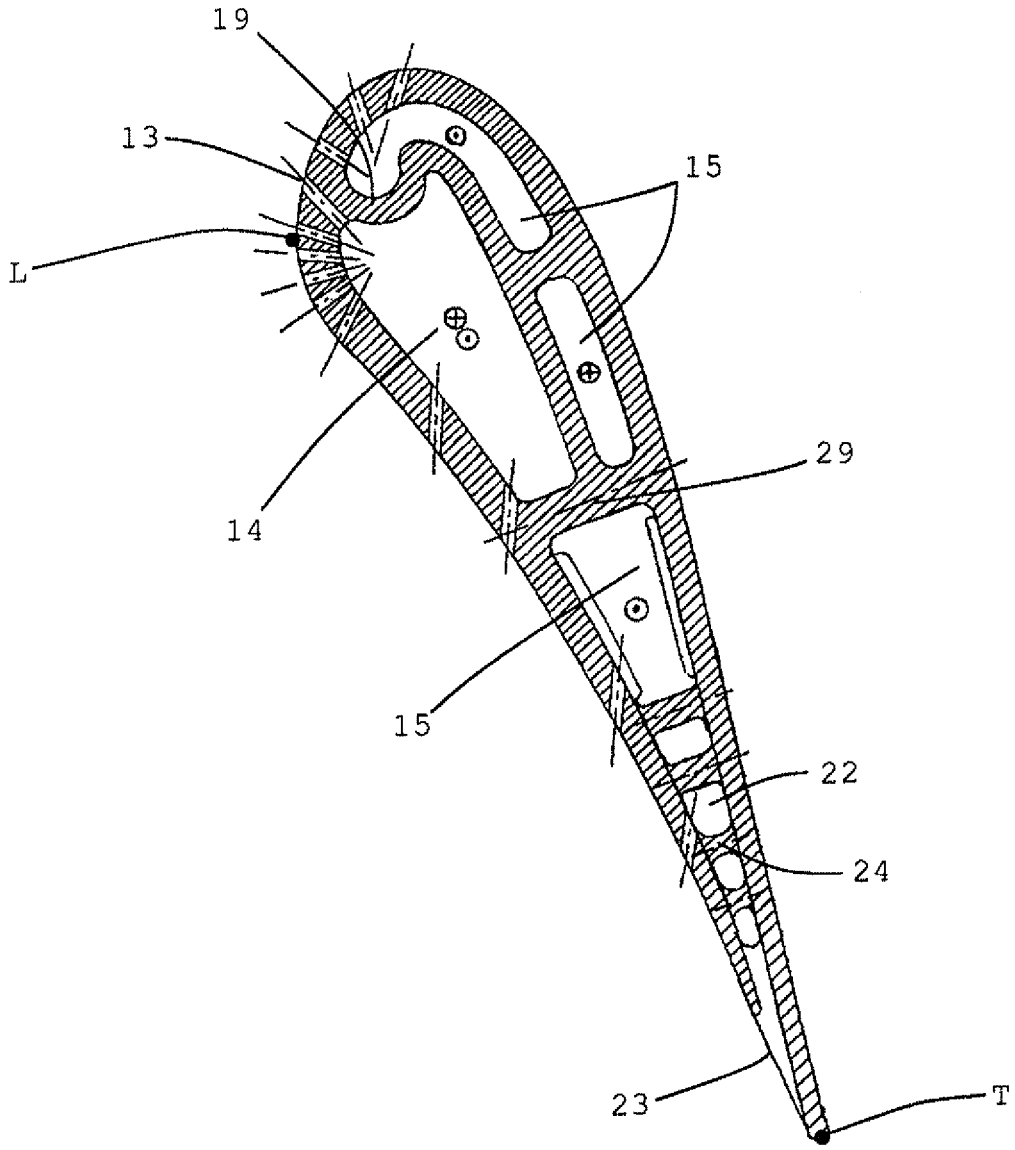
FIG. 6 shows a cross-sectional view through a fourth embodiment of an HP turbine NGV aerofoil.

FIG. 6 shows a cross-sectional view through a fourth embodiment of an HP turbine NGV aerofoil.

The fourth embodiment is similar to the first embodiment However, the cross-section area the first pass of the serpentine second passage 15 is reduced and a straight mid-chord wall 29 is introduced. This type of arrangement could be employed if more flow area is required in the second and third passes of the second passage to accommodate variations in heat load distribution.

Figure 7:
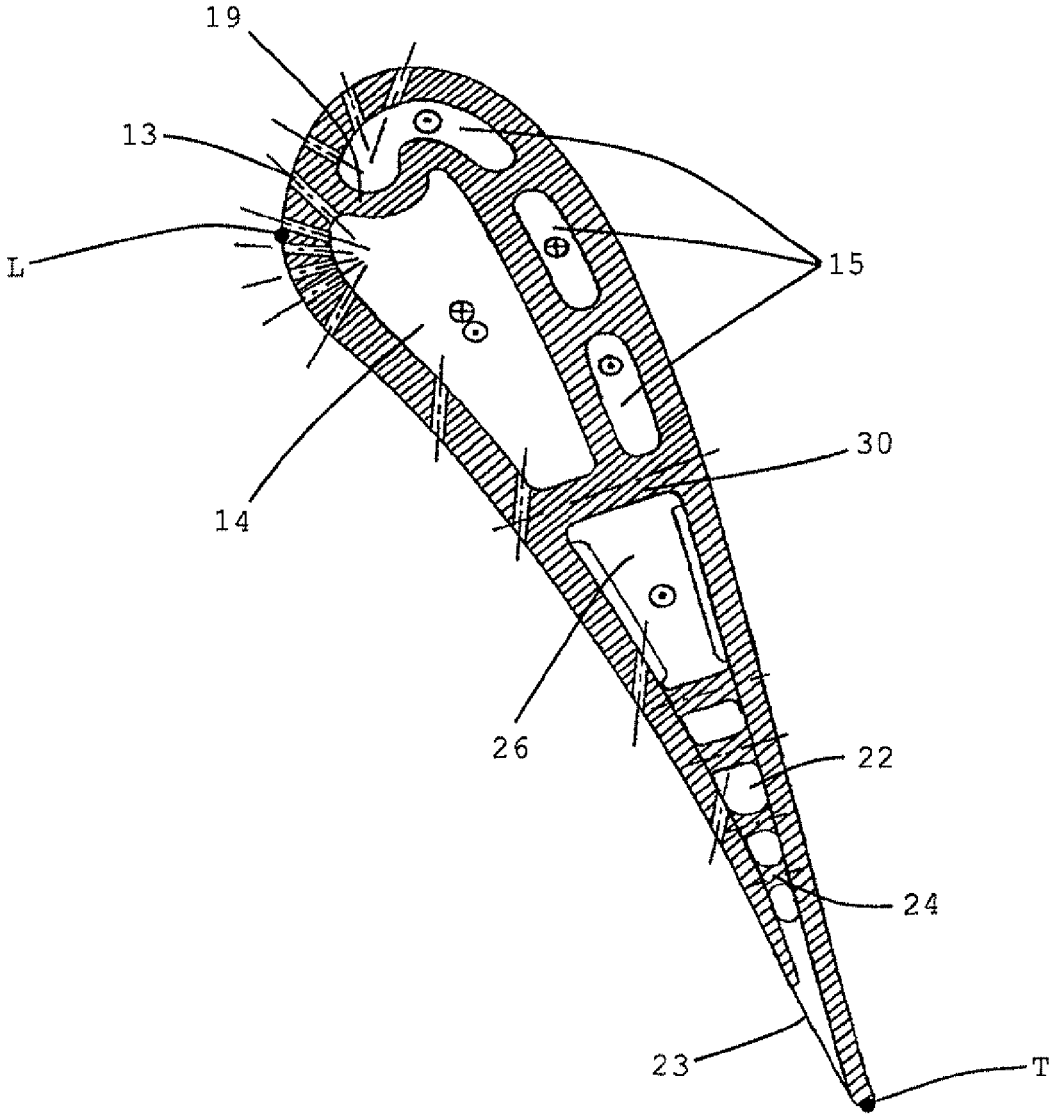
FIG. 7 shows a cross-sectional view through a fifth embodiment of an HP turbine NGV aerofoil.

FIG. 7 shows a cross-sectional view through a fifth embodiment of an HP turbine NGV aerofoil.

The fifth embodiment is similar to the second embodiment in that a third and separate radially-extending internal passage 26 carries cooling air with an axial rearward flow into the trailing edge cavity 22. However, the fifth embodiment also incorporates a straight mid-chord wall 30 which divides the third passage from the first 14 and second 15 passages.

Figure 8:
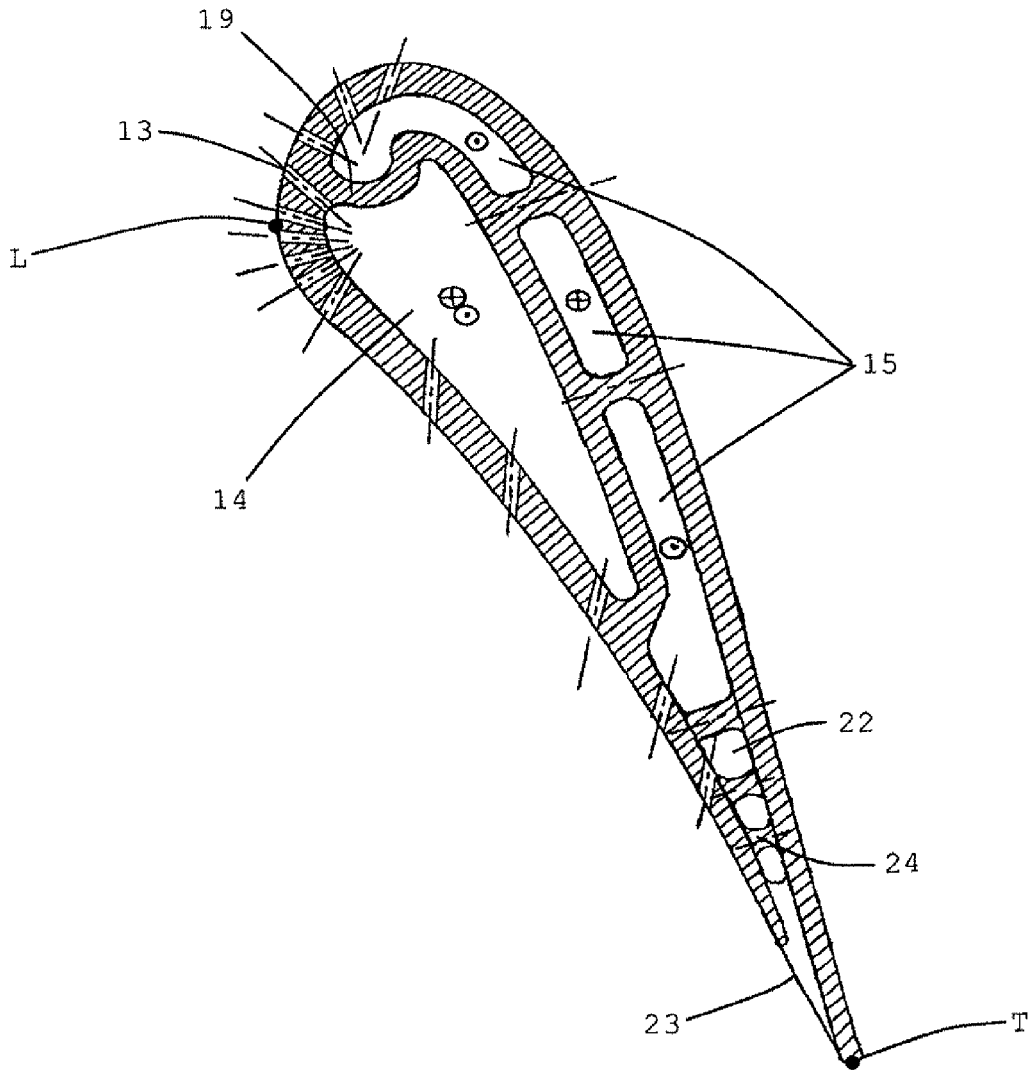
FIG. 8 shows a cross-sectional view through a sixth embodiment of an HP turbine NGV aerofoil.

FIG. 8 shows a cross-sectional view through a sixth embodiment of an HP turbine NGV aerofoil.

The sixth embodiment is similar to the first embodiment However, in the sixth embodiment the cross-sectional area of the first passage 14 is increased, and the cross-sectional shape of the second passage 15 is elongated in the fore-aft direction.

The above embodiments provide the following advantages:

- The first passage 14 provides a low pressure drop for the cooling air fed to the external holes 13 fed by that passage, matching the high static pressure of the hot gas at the leading edge and pressure surface to avoid hot gas ingestion.
- The second passage 15 provides a high velocity flow which thus has a high Reynolds number to increase internal heat transfer at the suction surface.
- The first 14 and second 15 internal passages (and optionally the third internal passage 26) can be formed by respective cores during casting, leading to relatively low cost production costs.
- Various forms of flow-disrupting formations can be provided in the second passage 15 to increase heat transfer levels.
- A high pressure drop multi-pass second passage 15 or a highly flow-disrupted forward flowing second passage reduces the feed pressure to the suction surface external holes 13, matching the low static pressure of the hot gas at the suction surface to avoid cooing layer blow off.
- The lower pressure of the cooling air feed to the suction surface external holes 13 allows the number of holes to be increased while maintaining the same overall flow level, which improves film coverage and hence film effectiveness.
- The wall 19 between the first 14 and second 15 passages provides a double skin geometry towards the suction side of the aerofoil which increases the ballooning and burst resistance of the aerofoil under the high pressure differential between the cooling air in the first passage and the external static pressure of the hot gas on the suction surface of the aerofoil.
- The high suction surface internal heat transfer coefficient maximises the thermal protection provided by any TBC applied to the aerofoil.
- On the suction surface, the cooling benefit of the suction surface external cooling layer reduces from fore to aft, while the internal heat transfer increases from fore to aft, whereby the external cooling layer and the internal heat transfer can be complimentary and help to provide an isothermal surface metal temperature.

In general, these advantages allow an NGV aerofoil according to the present invention to be configured with a reduced maximum aerofoil thickness, which can improve the aerodynamic shape and increase stage efficiency. Alternatively, or additionally, the pressure drop across the combustor can be reduced which allows the pressure drop across the turbine to be increased thereby improving engine performance.

While the invention has been described in conjunction with the exemplary embodiments described above, many equivalent modifications and variations will be apparent to those skilled in the art when given this disclosure. For example:

- The second passage 15 could have an aft section in which a multi-pass arrangement then feeds a predominantly axial flow arrangement through a series of pedestals or pin-fin heat transfer augmentation devises before exiting through the pressure side trailing edge.
- The second passage 15 could have a fore section with predominantly radial flow progressively bled through the gaps between a series of elongated pedestals, which allow the flow to escape in a controlled manner. The flow could further be restricted by arranging for it to impinge directly on to a row of pedestals aligned with the gaps. Such a geometrical arrangement can function as a supply manifold and can deliver an equal distribution of cooling flow forward to the leading edge compartment, providing sufficient pressure drop to further reduce the suction surface film cooling blowing rate.
- The sub-cores for casting the respective passes of a multi-pass second passage 15 could be strengthened with cross ties. The ties would produce short circuit channels in the aerofoil for a portion of the cooling air flow, but the amount of short circuiting flow could be kept relatively low.
- A multi-pass arrangement could be incorporated into the downstream portion of the suction side configuration in place of the downstream cavity 22.

Accordingly, the exemplary embodiments of the invention set forth above are considered to be illustrative and not limiting. Various changes to the described embodiments may be made without departing from the spirit and scope of the invention.

The invention claimed is:

1. A cooled aerofoil for a gas turbine engine, the cooled aerofoil comprising:

an aerofoil section having pressure and suction surfaces extending between inboard and outboard ends of the aerofoil section, the aerofoil section including:

first and second internal passages for carrying cooling air; and a plurality of external holes in the external surface of the aerofoil section which receive cooling air from the internal passages, the external holes being arranged such that: (1) cooling air exiting from a first portion of the external holes participates in a cooling film extending from the leading edge of the aerofoil section over the pressure surface and (2) cooling air exiting from a second portion of the external holes participates in a cooling film extending from the leading edge over the suction surface, wherein the first portion of external holes receives cooling air from the first internal passage, the second portion of external holes receives cooling air from the second internal passage, and the first and second internal passage are supplied with cooling air from respective and separate passage entrances, each passage entrance being located at either the inboard end or the outboard end of the aerofoil section, and the second internal passage is a high pressure drop multi-pass passage or a highly flow-disrupted passage configured to reduce a coolant air pressure to the suction surface external holes such that the coolant air pressure matches the low static pressure of a hot gas at the suction surface to avoid disrupting the cooling film, wherein the second internal passage includes: (1) a fore section which extends towards the leading edge and (2) an aft section, the cooling air entering the aft section before the fore section, the flow direction of the cooling air in the aft section being predominantly radial, and the flow direction of the cooling air in the fore section being predominantly in aft-fore direction.

2. The cooled aerofoil according to claim 1, wherein the aerofoil is a stator vane.

3. The cooled aerofoil according to claim 1, wherein the first and second internal passages are separated by a dividing wall which extends from the leading edge of the aerofoil.

4. The cooled aerofoil according to claim 1, wherein the first internal passage is supplied with cooling air from passage entrances located at both the inboard end and outboard end of the aerofoil section.

5. The cooled aerofoil according to claim 4, wherein the first internal passage contains a baffle to prevent cooling air supplied by the entrance located at one of the inboard or outboard ends from exiting the first internal passage at the entrance located at the other of the inboard or outboard ends.

6. The cooled aerofoil according to claim 1, wherein the passage entrances widen in the direction opposite to the direction of air supply.

7. The cooled aerofoil according to claim 1, wherein the second internal passage includes flow-disrupting formations on its internal surface to increase heat transfer between the cooling air and the aerofoil section.

8. The cooled aerofoil according to claim 1, wherein the entrance for the second internal passage is approximately located at the inboard end of the aerofoil section.

9. The cooled aerofoil according to claim 1, wherein the aerofoil section includes a further external hole or a plurality of external holes at its trailing edge, the second internal passage also supplying cooling air to the trailing edge external hole(s).

10. The cooled aerofoil according to claim 1, wherein the cooled aerofoil is formed by a casting procedure, in which the internal passages are formed during the casting procedure.

11. The cooled aerofoil according to claim 1, wherein the cooling air passes through the second internal passages in a forward flowing direction.

12. The cooled aerofoil according to claim 1, wherein a coolant air feed to the suction external holes in the second passage is at a lower pressure than the cooling air feed in the first passage.

13. A cooled aerofoil for a gas turbine engine configured to separate flows of cooling air to aerofoil surfaces having different external static pressures, the cooled aerofoil comprising:

an aerofoil section having pressure and suction surfaces extending between inboard and outboard ends of the aerofoil section, the aerofoil section including:

a first and a second internal passage configured to carry cooling air, the first and second internal passage being supplied with cooling air from respective and separate passage entrances, each passage entrance being located at either the inboard end or the outboard end of the aerofoil section; and a plurality of external holes in the external surface of the aerofoil section configured to receive cooling air from the internal passages, the external holes being arranged such that: (1) cooling air exiting from a first portion of the external holes contribute to a cooling film extending from the leading edge of the aerofoil section over the pressure surface and (2) cooling air exiting from a second portion of the external holes contribute to a cooling film extending from the leading edge over the suction surface, wherein the first portion of external holes receives cooling air from the first internal passage, the second portion of external holes receives cooling air from the second internal passage, and the second internal passage is a high pressure drop multi-pass passage or a highly flow-disrupted passage configured to reduce a coolant air pressure to the suction surface external holes such that the coolant air pressure matches the low static pressure of a hot gas at the suction surface to avoid disrupting the cooling film, wherein the second internal passage includes: (1) a fore section which extends towards the leading edge and (2) an aft section, the cooling air entering the aft section before the fore section, the flow direction of the cooling air in the aft section being predominantly radial, and the flow direction of the cooling air in the fore section being predominantly in aft-fore direction.

* * * * *